US012392153B2

(12) United States Patent
Massa

(10) Patent No.: US 12,392,153 B2
(45) Date of Patent: Aug. 19, 2025

(54) SWIMMING POOL STRUCTURE WITH AN EDGE GUTTER

(71) Applicant: MA.MI. INTERNATIONAL S.R.L., Lumezzane (IT)

(72) Inventor: Marco Massa, Bussolengo (IT)

(73) Assignee: MA.MI. INTERNATIONAL S.R.L., Lumezzane (IT)

( * ) Notice: Subject to any disclaimer, the term of this patent is extended or adjusted under 35 U.S.C. 154(b) by 66 days.

(21) Appl. No.: 17/907,871

(22) PCT Filed: Feb. 26, 2021

(86) PCT No.: PCT/IB2021/051617
§ 371 (c)(1),
(2) Date: Aug. 29, 2022

(87) PCT Pub. No.: WO2021/171242
PCT Pub. Date: Sep. 2, 2021

(65) Prior Publication Data

US 2023/0151627 A1 May 18, 2023

(30) Foreign Application Priority Data

Feb. 27, 2020 (IT) ..... 102020000004108

(51) Int. Cl.
*E04H 4/12* (2006.01)

(52) U.S. Cl.
CPC ..... *E04H 4/1227* (2013.01); *E04H 4/1245* (2013.01)

(58) Field of Classification Search
CPC ..... E04H 4/1227; E04H 4/1218
See application file for complete search history.

(56) References Cited

U.S. PATENT DOCUMENTS 1,186,540 A * 6/1916 Rohmer ..... E04H 4/1227 4/511
4,483,025 A * 11/1984 Meredith ..... E04H 4/1227 4/510
2017/0058545 A1 3/2017 Freeby

FOREIGN PATENT DOCUMENTS

DE 2550520 A1 5/1977
DE 202013102082 U1 * 10/2013 ..... E04H 4/1227
EP 0899397 A1 * 3/1993
EP 0594975 A1 * 5/1994
(Continued)

OTHER PUBLICATIONS

Machine translation of DE 2550520 A1 (Year: 2024).*
International Search Report for PCT/IB2021/051617 dated Jun. 16, 2021 (2 pages).

*Primary Examiner* — Erin Deery
(74) *Attorney, Agent, or Firm* — Tutunjian & Bitetto, P.C.

(57) ABSTRACT

Swimming pool structure having at least one edge zone including a first surface which delimits and surrounds a main tank (MB) for water containment and at least one top wall designed to allow the passage of users from the external towards said tank (MB), said pool structure also including a water collection, filtering and recirculating circuit in the main tank (MB), in which said at least a top wall includes at least a respective segment inclined with respect to the horizontal and has at least an opening or groove or a structure such as to allow the passage of water through it so as to be conveyed towards said circuit.

14 Claims, 3 Drawing Sheets

(56) References Cited

FOREIGN PATENT DOCUMENTS

| | | | | |
|---|---|---|---|---|
| EP | 3211157 | A1 * | 8/2017 | ..... C08K 3/40 |
| WO | 2004015225 | A1 | 2/2004 | |

* cited by examiner

SWIMMING POOL STRUCTURE WITH AN EDGE GUTTER

TECHNICAL FIELD OF THE INVENTION

The present invention relates to a swimming pool structure as well as a method of restoring or adapting a swimming pool structure.

STATE OF THE PRIOR ART

The pools, as regard to the water recycling and filtration system, are of two main types, skimmer pools and infinity pools.

Skimmer pools are the most common and have a perimeter edge outside the surface of the water on which the skimmer or spillway openings are distributed. The water is collected, filtered and re-introduced by means of these openings into the pool through special delivery vents.

The skimmers must be properly positioned and correctly sized, so as not to generate dead zones where water stagnates.

The infinity pools, on the other hand, are usually full to the brim and the water overflows around and flows into a special perimeter channel, thereby ensuring that the surface of the water is continuously and uniformly cleaned.

Infinity pools generally work well they are very expensive for their construction and, above all, for their operation.

The skimmer pools, on the other hand, cause a mixing of the water, but the corners of these pools always remain dirty.

Moreover, both in the case of infinity pools and in the case of skimmer pools proposed so far, compensation tanks as well as technical rooms are necessary that are difficult to maintain, mainly due to the hygienic conditions and the arrangement below the pools.

DE2550520A1 and US2017058545A1 teach respective solutions in accordance with the state of the prior art.

SUMMARY OF THE INVENTION

An object of the present invention is to provide a new swimming pool structure.

Another object of the present invention is to provide a swimming pool structure which ensures the maintenance of an excellent level of cleanliness.

Another object of the present invention is to provide a swimming pool structure with an economical cleaning system.

Another object of the present invention is to provide a swimming pool structure which is easy and economical to maintain.

According to one aspect of the invention, a swimming pool structure is provided according to the present application.

The present application refers to preferred and advantageous embodiments of the invention.

BRIEF DESCRIPTION OF THE DRAWINGS

Other features and advantages of the invention will be more evident from the description of an embodiment of a swimming pool structure, illustrated by way of example in the accompanying drawings in which.

In the accompanying drawings, identical parts or components are indicated by the same reference numbers.

DETAILED DESCRIPTION OF THE INVENTION

Figure 1:
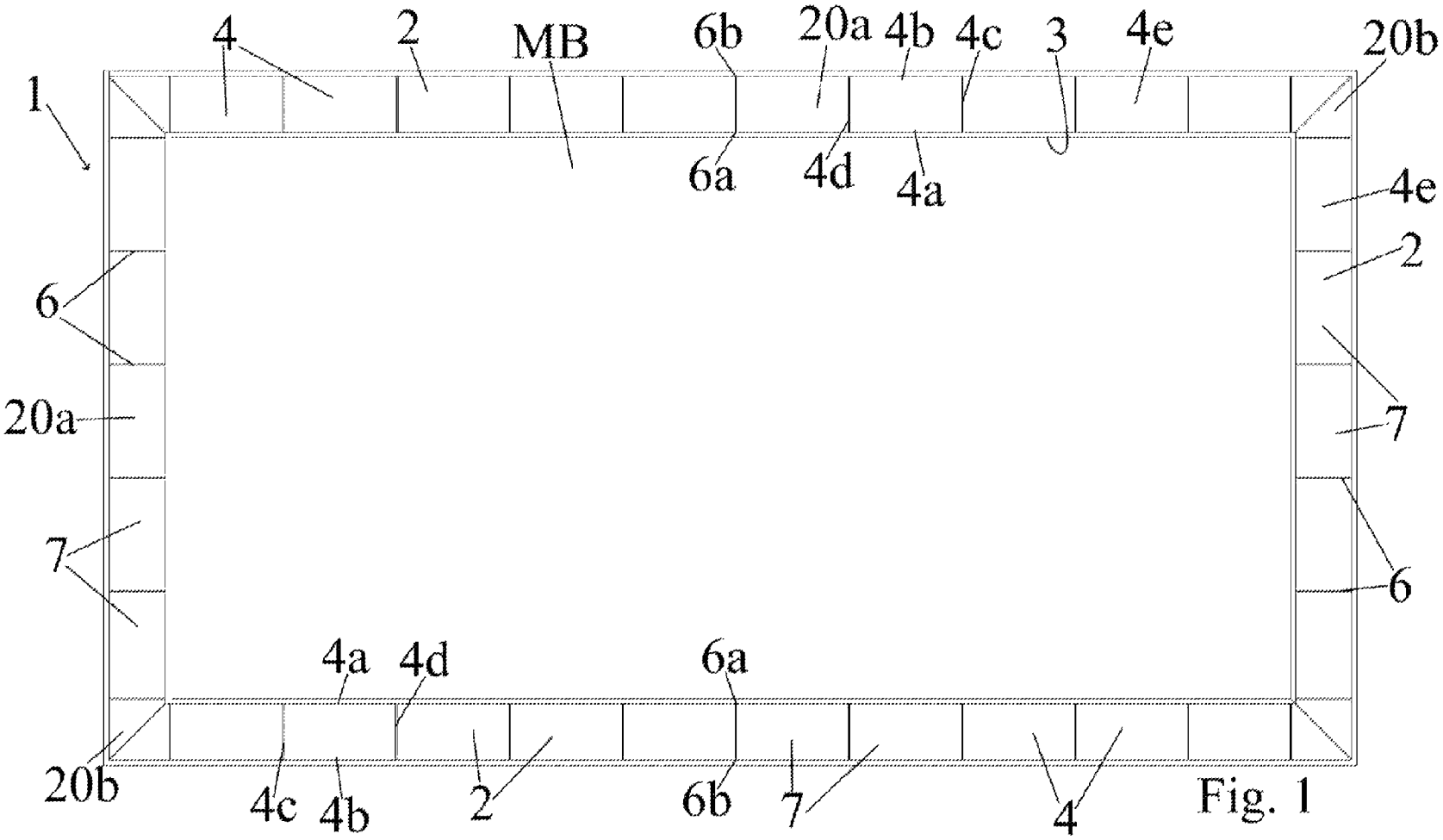
FIG. 1 is a top view of a swimming pool according to the present invention.
Figure 3:
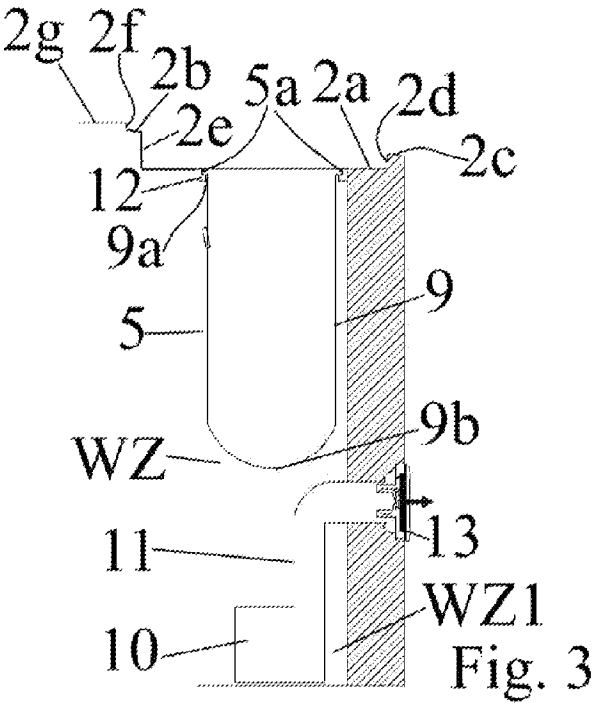
FIG. 3 is a view similar to FIG. 2 with parts removed.
Figure 2:
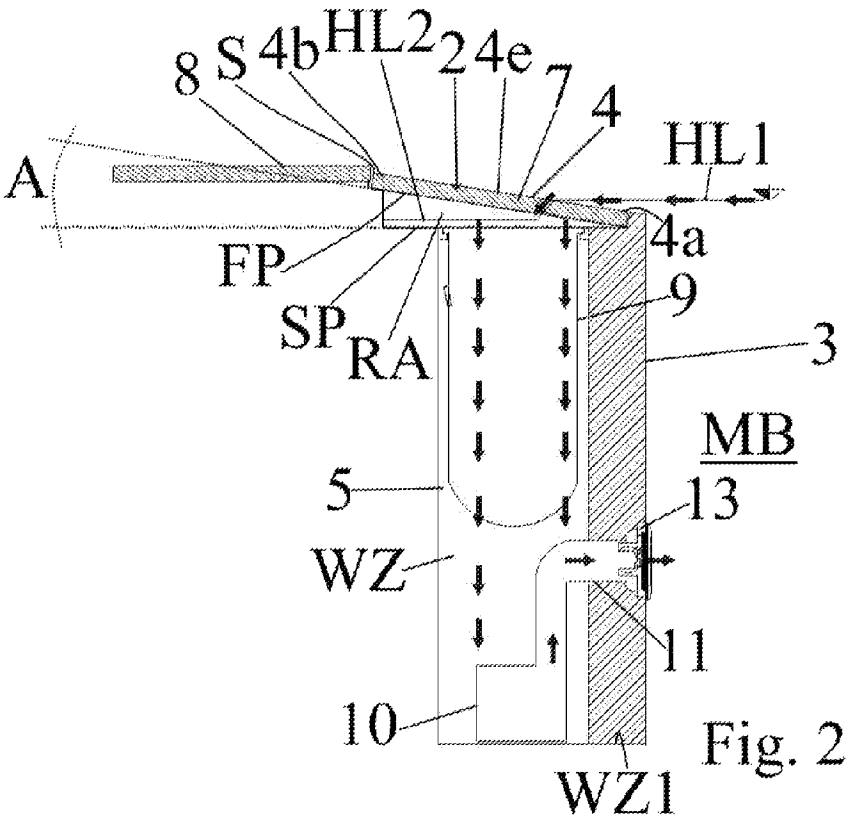
FIG. 2 is a cross-section view of a detail on an enlarged scale of the swimming pool structure of FIG. 1.

With reference to the attached figures, a swimming pool structure 1, for domestic or public use, has been illustrated, having at least one edge zone 2 with a first surface 3 which delimits and surrounds a main tub MB for water containment and at least a first top wall 4 designed to allow the passage of users from the outside towards the tank MB and from the latter towards the outside so as to allow them to enter and exit the tank MB.

The first surface 3 can be, in use, vertical or substantially vertical or even curved.

Of course, the edge zone 2 comprises a main block made of suitable material, such as concrete or other, and the first surface 3 is a free internal surface of this block, covered or not with tiles.

The top wall 4, on the other hand, can be rested or constrained at the top of this block, for example as will be better explained below, or it can be the top of this block.

Therefore, the top wall 4 surrounds all or, if desired, also part of the perimeter of the upper level of the main tank MB.

Moreover, the top wall 4 can be in contact with the first surface 3 or be slightly at distance from it, for example between 1 cm and 10 cm, if desired between 1 cm and 5 cm.

The swimming pool structure 1 also includes at least one water collection, filtering and recirculating circuit 5 from/in the main tank MB. Such circuit 5 is formed in the main block of the edge zone 2 and, if desired, also extends outside it, for example also partly under the tank MB.

The top wall 4 is defined by a series of adjacent and consecutive segments, which segments can each be formed by a respective component separate from the others or all in one piece or, alternatively, two, three or more units of segments, each in one piece only separate from the other units.

Each segment of the top wall has a first front edge 4*a*, a second rear edge 4*b* and two respective side edges 4*c*, 4*d* which together with the first front edge 4*a* and the second rear edge 4*b* define the actual (if each segment corresponds to a respective tile) or ideal (if each segment corresponds to a part of the top wall 4, without the latter being made up of different elements or tiles placed side by side) perimeter of a segment of the top wall.

If desired, the first front edge 4*a* and the second rear edge 4*b* are parallel and/or the two side edges 4*c*, 4*d* are parallel. According to the non-limiting embodiment illustrated in the figures, the side edges 4*c*, 4*d* are orthogonal to the front 4*a* and rear 4*b* edges.

Clearly, the first front edge 4*a* is proximal to the tank MB, the second rear edge 4*b* is distal from the tank MB or at a distance from the latter greater than the first front edge 4*a* and the two side edges 4*c*, 4*d* each develop from a respective end of the first front edge 4*a* to a respective end of the second rear edge 4*b*.

It will be understood that each segment has a respective side edge 4*c* facing and substantially parallel or coinciding with a side edge 4*d* of a segment adjacent to it, while the first front edge 4*a* of a segment will be substantially aligned with or in any case will constitute the continuation of the first front edge 4*a* of a segment adjacent to it and the second rear edge 4*b* of a segment will be substantially aligned with or in any case will constitute the continuation of the second rear edge 4*b* of a segment adjacent to it.

As regards in particular the top wall 4, it has at least one respective segment inclined with respect to the horizontal and having at least one opening or groove 6 or in any case a structure such as to allow the passage of water through it in the direction from top to bottom so as to be conveyed towards the circuit 5, which extends starting from an area below this segment of the top wall 4 or in any case starting from a level lower than it, and is in fluid communication with the/and opening(s) or groove(s) 6 or with the porous surface of the segment so as to receive water, leaving the main tank MB, which should pass through it.

If grooves 6 are provided, they could have a width, for example between 1 and 100 mm, if desired between 5 mm and 25 mm or between 8 and 15 mm.

The top wall 4 can be made of a suitable material, such as ceramic, marble, agglomerate, etc.

In the event that the top wall 4 must allow the passage of water, but it does not delimit through grooves, then it or the respective segment(s) can be made of porous material, if desired draining agglomerates with porosity for example between 10 and 500 m2 g-1.

Preferably, the top wall 4 or better each segment thereof has the first front edge 4*a* in contact with or resting on a first part 2*a* of the edge zone 2 proximal to the first surface 3 and the second rear edge 4*b* in contact with or resting on a second part 2*b* of the edge zone 2 distal from the tank MB with respect to the first surface 3.

Advantageously, but not necessarily, the top wall 4 or better the respective segments are kept in position only by gravity or according to their own weight and are not bound, for example by means of a special mixture, such as cement, to the other components of the swimming pool structure 1 or better to the main block.

With reference to at least one segment of the top wall 4, it has the respective first edge 4*a* at a level, in use, that is lower i.e. vertically lower than the second edge 4*b*, so that the angle A defined between the portion of a first plane FP connecting the first edge 4*a* and the second edge 4*b* of the respective segment and the portion of a second horizontal plane SP underlying this portion of the first plane FP is greater than 0°. Advantageously, this angle ranges between 5° and 60° or between 5° and 25° and even more advantageously between 5° and 10°.

Basically, at least one segment 7 of the top wall 4 is substantially inclined with respect to the horizontal so that the respective level or vertical position decreases as it approaches the main tank MB.

The length of this segment of the top wall 4, i.e. the distance between the first 4*a* and the second 4*b* edge, can be for example between 5 cm and 100 cm, if desired, about 20-25 cm.

Advantageously, the first edge 4*a* and the second edge 4*b* are preferably parallel to each other and with a main extension dimension which is horizontal and lying in a vertical plane parallel to the plane where the first surface 3 lies, or better the portion of first surface 3 closest to this first and second edge 4*b*. This condition must therefore be evaluated as a function of the part of the edge zone 2 considered from time to time, since the first surface 3 has a different arrangement according to the respective part of the edge zone 2 and the same applies, clearly for the edges 4*a* and 4*b* from time to time concerned.

The angles and dimensions of the components now indicated must in any case be such as to allow users to enter and exit the tank MB, without them slipping. In this regard, the top wall 4 or one or more segments thereof can be made or covered with a suitable anti-slip material.

Moreover, the dimensions and inclination of the top wall 4 or of one or more segments 7 of the same also serve to improve the hydraulic containment system of the pool.

Each segment can be constituted in particular by a respective tile 7, so that there would be a plurality of tiles 7 side by side and, if desired, bound together to define the top of the edge zone 2. The tiles 7 would in this case be arranged side by side to the other until the top wall 4 is formed. Clearly one or more tiles 7 could be fixed with a suitable mixture, for example cement, and others could instead only be placed on respective supporting parts. The latter could be easily disassembled to access the circuit 5 or the inlet opening 5*a* of the same.

In this case, one or more or clearly all the tiles 7 could be inclined as indicated above.

The tiles 7, if provided, have any suitable configuration, for example square or rectangular, with sides parallel two by two, two 4*c*, 4*d* inclined according to the angle A with respect to the horizontal as indicated above and two 4*a*, 4*b* with horizontal main extension and lying in a vertical plane parallel to the plane where the first surface 3 lies or, better, the portion of the first surface 3 closest to such first and second edges 4*b*.

As indicated above for the segments, the tiles 7 are preferably placed side by side with the same inclination and respective sides in contact or in any case adjacent along straight portions 20*a* of the edge zone 2, while the curved parts or the corners 20*b* of the edge zones could be obtained by appropriate shaping of the tiles 7.

Advantageously, the top wall 4 delimits at least a through groove 6, which can have a trim or attitude inclined with respect to the horizontal.

In this regard, a plurality (two, three, four or any number greater than ten, twenty, etc.) of through grooves 6 suitably spaced can be provided. These grooves 6 can be delimited one or more in each tile 7 and/or defined between adjacent tiles 7.

The through grooves 6 can extend, for example, in a rectilinear direction, if desired, along a direction of passage from the first 4*a* to the second edge 4*b*, in particular along a direction corresponding or parallel to the shortest distance between the same edges. If desired, the through grooves 6 are parallel to the lateral edges 4*c*, 4*d* of a respective segment or tile 7.

With reference to the non-limiting embodiment illustrated in the figures, the through grooves 6 lie in a vertical plane orthogonal to the first surface 3 or to a plane tangent to it. This condition must be clearly evaluated as a function of the part of the edge zone 2 considered from time to time, since the first surface 3 has a different arrangement according to the respective part of the edge zone 2 and the same applies, clearly for the edges 4*a* and 4*b* from time to time concerned.

The through grooves 6 can extend inclined with respect to the horizontal according to the angle A indicated above.

Of course, the though grooves 6 could also have a different configuration, if desired also curved or with multiple portions inclined to each other, but in any case it is important that they have two terminal ends 6*a*, 6*b* at different levels or better one 6*a* end proximal to a first edge 4*a* and distal from the other 4*b*, and the other proximal to the second edge 4*b* and distal from the other, so that the first terminal end 6*a* is at a level, in use, that is lower than the second terminal end 6*b*.

If the top wall 4 is composed of tiles 7, then, as already partially indicated above, the through grooves 6 can (although this is clearly not a necessary condition) be aligned on two sides 4*c*, 4*d* of a respective tile 7 and they can be formed in the middle of the latter or between pairs of adjacent tiles 7.

The length of the grooves 6 can be any suitable length, for example between 1 mm and 1000 mm, for example between 100 mm and 800 mm or between 500 mm and 800 mm.

Clearly, the first part 2*a* of the edge zone 2 is at a lower level than the second part 2*b*.

Moreover, the intermediate portion 4*e* of at least one segment (or all the segments) of the top wall 4, which extends between the first edge 4*a* and the second edge 4*b*, is not supported from below by the main block of the edge zone 2, i.e. the latter has a recessed area RA which subtends the intermediate portion 4*e* of the aforementioned segment 7 of the top wall 4. Therefore, the recessed area RA constitutes a sort of channel, if desired perimeter, for conveying water.

In accordance with the present invention, a first higher level HL1 of the water in the tank MB is obtained, while in the recessed area RA a second upper level HL2 is obtained which is lower, for example by two, three, four, five or more cm with respect to the first upper level HL1, so that the water is actually dragged towards the recessed area, through the groove/s 6 or the porous structure of the inclined segments of the top wall 4, and thus an acceleration of the flow of water through the top wall 4 or one or more segments thereof.

Basically, at least one segment 7, but preferably some or all of the segments of the top wall 4 is/are supported only at the respective edges 4*a*, 4*b* and not at the respective intermediate portion 4*e*. In such case, of course, the edges 4*c*, 4*d* would not be supported either. Alternatively, intermediate support bridges could be provided for the segments or tiles 7.

The above can be obtained by suitably shaping the main block of the edge zone 2 or also the tiles 7.

With regard to this aspect, considering the direction starting from the first surface 3 away from the main tank MB, the edge zone 2 can comprise a first section 2*c*, for example curved, horizontal or slightly inclined with respect to the horizontal, then a second section 2*d*, for example vertical or slightly inclined with respect to the vertical so that the level or vertical position of the second section 2*d* decreases away from the first section 2*c*. The first section 2*c* essentially defines, according to the non-limiting embodiment illustrated in the figures, the distance between the top wall 4 and the first surface 3.

Therefore, the first part 2*a* is provided from the second section 2*d* away from the main tank MB, which part 2*a* consists for example of a third section substantially flat and horizontal or slightly inclined with respect to the horizontal, which is at a level or vertical position lower than the first section 2*c*, so that a stable positioning step of the first edge 4*a* is actually determined.

After the first part 2*a* or third section a fourth section 2*e* is provided, if desired vertical or slightly inclined with respect to the vertical and therefore the second part 2*b*, consisting for example of a fifth section, which is at a level or vertical position higher than the first part 2*a* and, if desired, to the first section 2*c*.

The edge zone 2 can also then include, starting from the second part 2*b*, a sixth section 2*f*, if desired vertical or slightly inclined with respect to the horizontal, thus reaching the seventh section or highest section 2*g* of the edge zone 2. Between the second part 2*b* and the sixth section 2*f* a second step for the stable positioning of the second edge 4*b* is defined, which is defined for example by a recessed corner.

With reference to the above, the first part 2*a* and/or the recessed corner 2*b*-2*f* can be inclined according to the above indicated inclination direction (angle A).

If desired, one or more second top walls 8 are also provided, placed on the seventh section 2*g* of the edge zone 2. The second top wall 8 can be made by means of respective second tiles suitably placed side by side. Clearly, one or more or all of these second tiles could be fixed with a suitable mixture, for example cement and others could or may not be placed on respective supporting parts 2*g* only.

Between the first 4 and the second top wall 8, if desired between the respective tiles, a slot S can be defined, for example for recovering any wave motion in the swimming pool structure 2.

The description provided of the high part of the main block of the edge zone 2 applies in particular to the case where at least one segment of the top wall 4 is straight, but it could also be curved.

Alternatively, in particular if at least one segment of the top wall 4 is very curved, then the structure described above for the edge zone 2 may not be arranged and in particular the sections 2*f* and 2*g* may not be provided.

Moreover, regardless of the straight or curved configuration of the top wall, the edge zone 2 could not include a first section 2*c*, but for example a recess for receiving the first edge 4*a*.

As indicated above, the description now provided for a segment of the top wall is preferably applied to the entire top wall 4 or, if desired, only to at least a quarter, at least half or at least two thirds thereof.

Moreover, the above description of the configuration of a segment 7 of the top wall 4 relates to a section of the same taken along a vertical plane or in any case vertical to the installation ground of the swimming pool structure 1 and orthogonal to the first surface 3 or to a tangent plane to the same.

This condition must be clearly evaluated according to the part of the edge zone 2 considered from time to time, since the first surface 3 has a different arrangement according the respective part of the edge zone 2 and the same applies, clearly for the edges 4*a* and 4*b* from time to time concerned.

Clearly a segment or tile 7 always has the same position or attitude moving in the direction from one side to the other of the segment or in any case along the perimeter development direction of the respective part of the edge zone 2.

Thus, for example, considering a swimming pool structure 1 with a rectangular edge zone 2, with two major sides and two minor sides as illustrated in the nonlimiting embodiment of FIG. 1, then the segments or tiles 7 may or may not always have the same position along a direction parallel to the respective side (greater or lesser) to which the segment under examination belongs. In this regard, depending on the type of laying of the flooring around the main tank MB, the arrangement of the tiles in the edge zone may vary.

If a segment belonged to a curved part of the edge zone 2 then the position of this segment would remain the same parallel to the development of this curved part.

With regard to the collection, filtering and recirculation circuit 5, as indicated above, it develops from an area below the top wall 4 and is in fluid communication with the opening(s) and/or groove(s) 6 or with the porous surface of the top wall 4 so as to receive water which should pass through it.

More particularly, the circuit 5 has at least one inlet mouth or opening 5*a* opening under the top wall 4 or a segment 7 thereof and in particular under the intermediate portion 4*e* or an intermediate portion 4*e*.

The inlet mouth or opening 5*a* can, for example, have a circular, square, rectangular or other type section.

The inlet mouth or opening 5*a* can subtend and have a diameter or a size corresponding to at least half or at least two thirds of the distance between the first edge 4*a* and the second edge 4*b* of an overlying segment 7.

If desired, the inlet mouth or opening 5*a* is delimited or formed in the first part 2*a* and more particularly in the respective third section, for example substantially flat and horizontal. Thus, for example, the inlet mouth opening 5*a* can be delimited in an intermediate or substantially central portion of the third section 2*a*, so that the third section, which actually constitutes the first part 2*a*, has a portion close to or proximal to the first surface 3 and a portion distal from the first surface 3 from which a fourth section 2*e*, if provided can extend upwards.

Naturally, two or more inlet mouths openings 5*a* could be provided, for example four or more suitably distributed along the perimeter of the edge zone 2.

In this case, a plurality of grooves 6 or porous tiles 7 could be provided, all opening below on the first part or third section 2*a*, so as to convey the pool water to be filtered towards the inlet openings 5*a*.

In accordance with this variant, in order to ensure that the water passed through the grooves 6 or through the porous body of the tiles 7 is conveyed towards the inflow openings 5*a*, then the first part or third section 2*a* could be made of segments with different inclination so as to have a level or vertical position which decreases as it approaches the inlet openings 5*a*, so as to obtain a sort of funnel effect. This condition is of course not necessary, also considering the suction effect determined by the pumps or similar means provided in circuit 5.

As regards the specific non-limiting embodiment illustrated in the figures, the water collection, filtering and recirculating circuit 5 in the main tank MB comprises at least one well zone WZ for falling water arranged under the top wall 4, at least a filter 9, for example a bag filter, mounted in the well zone WZ and designed to intercept the water falling into it starting from the top wall 4. The circuit 5 then includes recirculation or movement means, such as a recirculation pump o fan or propeller 10 placed in a portion WZ1 of the well zone WZ downstream of the filter 9 or in any case arranged or mounted on the bottom WZ1 of the well zone WZ or in a position lower with respect to the filter 9. According to this, the recirculation or movement means 10 are crossed by water already filtered by the filter 9. Actually, the recirculation or movement means 10 are immersed in water.

As it will be possible to ascertain, according to the non-limiting embodiment shown in the figures, the water crosses the filter by gravity, according to the sieve principle.

Each well zone WZ is accessible from the top passing through a respective mouth or inflow opening 5*a*.

Therefore, several well zones WZ can be provided, if desired, two, three, four or more, each served by a respective inlet mouth or opening 5*a*.

If several well zones WZ are provided, they are distributed along the perimeter of the edge zone 2, so as to be suitably spaced from each other.

One or more well zones WZ can have a cross section, taken along a horizontal plane, which is circular or square or rectangular or of other suitable shape which polygonal or not polygonal. The cross section of a well zone is preferably substantially constant along a vertical direction.

The components of the collection, filtering and recirculation circuit 5 are compatible with all water sanitation substances and systems.

As regards the filter 9, a respective bag filter 9 can be mounted in each well zone WZ, which filter is sock-shaped with a first end 9*a* open and a second opposite or filtering end 9*b* closed. In this case, the first end 9*a* is mounted or constrained at the inlet mouth or opening 5*a* by means of one or more suitable blocks or the like 12, in particular so that the seal is maintained between the end 9*a* and the wall delimiting or defining the inlet mouth or opening 5*a*.

The filter 9 could be made of a low resistance filtering material, for example it could include a bag or a net, in particular resistant to salt and chlorine and, if desired, machine washable.

The porosity of the filter 9 can be any suitable one, for example between 10 and 200 microns, if desired between 50 and 120 microns, for example about 60-70 or 90-100 microns. Clearly, by reducing the number of microns of porosity, the meshes are reduced and a better filtering of the water is obtained, but, on the other hand, by reducing the meshes too tightly, the filter is more easily clogged.

Of course, instead of a bag, one could use another type of filter, such as a filter mass or a cartridge.

The filter 9 is preferably anti-bacterial, algaecidal and washable.

At least one recirculation duct 11 of the water conveyed by the pump or fan 10 opening into the tank MB is also provided in circuit 5. Such recirculation duct 11 can extend between the outlet of the pump or fan 10 and a discharge opening or through hole extending in a side wall or portion of side wall 1*a*, if desired of the main block, between a respective well zone WZ and the tank MB. The recirculation duct 11 can then be provided with a special nozzle for dispensing water in the tank MB.

Quick or interchangeable coupling or attachment means 13 of the duct 11 in the discharge opening or through hole can then be provided.

The swimming pool structure 1 can also include an overflow opening which is in fluid communication with the sewer, so that if too many people or in any case when a certain number of people enter the tank MB, the water in the latter is discharged into such opening.

With regard to the recirculation or movement means, the same could include a low voltage pump, for example those usually used in aquariums.

For the power supply of the recirculation or movement means, a cable can be provided that is suitably guided out of the well zone WZ towards a junction box or long cable. Of course, a power supply of the recirculation or movement means by battery or solar energy can also be provided.

The recirculation or movement means may be such as to stop when there is no more water, therefore essentially when the voltage is too low and could also be of the variable speed type.

Figure 4:
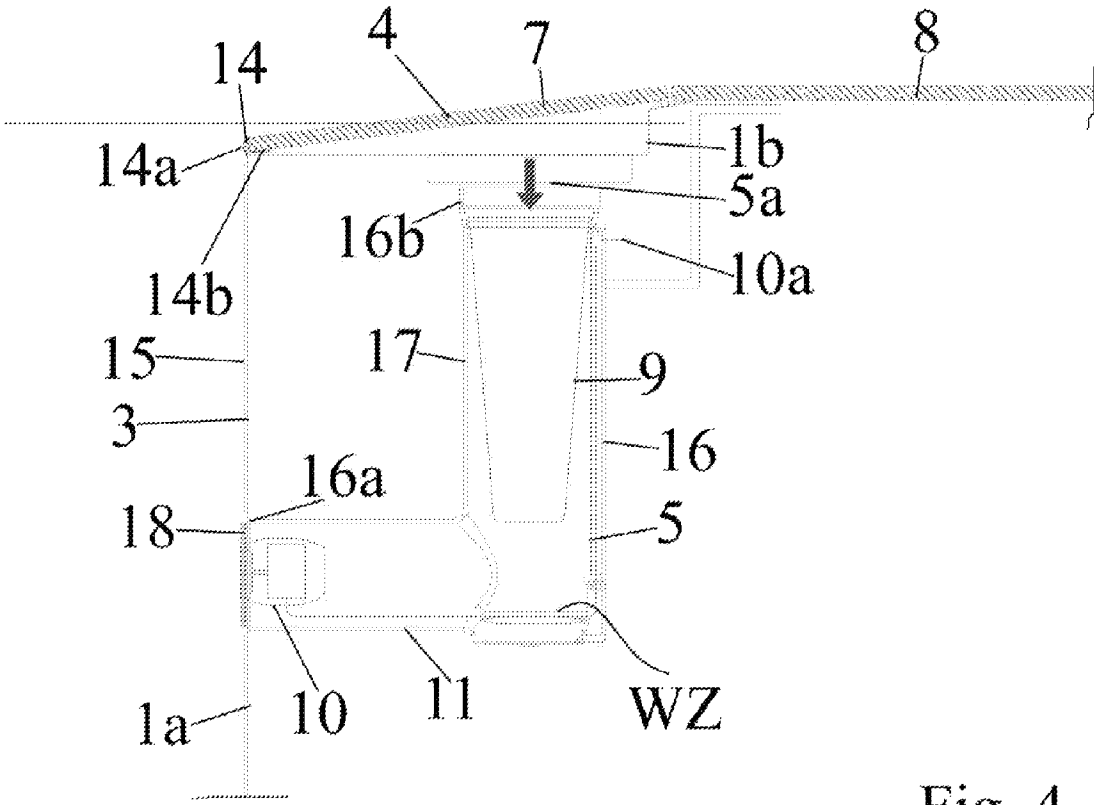
FIG. 4 is a schematic view of a detail of another embodiment of a swimming pool structure according to the present invention.

With reference now to FIG. 4, a variant of the present invention has been illustrated, which includes a retaining component 14 fixed, for example welded or glued at the upper end or corner of the first surface 3 or better of the delimiting wall of the same.

The retaining component 14 is designed to provide an abutment or containment surface for the first front edge 4*a*.

More specifically, the retaining component 14 can have a substantially vertical main portion 14*a* from which a portion 14*b* with horizontal main extension departs away from the main tank MB, which rests on the first part 2*a* or on the respective third section substantially flat and horizontal or slightly inclined with respect to the horizontal.

The upper surface of the main portion 14*a* can be curved and is also designed to constitute the first section 2*c*, while the upper surface of the horizontal main section 14*b* is designed to constitute the second section 2*d*.

The retaining component 14 can comprise a drawn made of rubber, PVC or other material, which is, for example, welded to the first surface 3 of the swimming pool, which can be coated for example by means of a membrane 15, if desired in PVC.

With reference then to the collection, filtering and recirculation circuit 5, it can also comprise a tubular element 16, if desired L-shaped or also with other geometry, a first end 16 thereof is fastened, for example by means of screws, bolts, welding, fitting to a side wall 1*a* of the swimming pool structure defining the first surface 3. More particularly, the end 16*a* is mounted in a discharge opening or through hole defined in the side wall 1*a*.

The other or second end 16*b* of the tubular element 16 is instead fixed, for example by means of screws, bolts, welding, fitting under a top wall 1*b* of the swimming pool structure 1. Naturally, the top wall 1*b* defines the parts 2*a*, 2*b* on which a top wall 4 can then be laid.

Clearly, the top wall 1*b* can be fixed either in one piece with the side wall 1*a* and can extend, if desired, also cantilever extend, from the latter.

In this case, the recirculation duct 11, which opens into the tank MB, could constitute a portion, if desired horizontal, of the tubular element 16, which could also include a supply duct 17, in use, substantially vertical or inclined with respect to the vertical, which extends between the inlet mouth or opening 5*a* and the recirculation duct 11

The recirculation or movement means, such as a pump or fan or propeller 10, could be mounted in any point of the tubular element 16, for example at the first end 16*a*, i.e. in the same or at 1-10 cm from it.

If desired, a containment component 18, such as a grid, can also be provided, which is mounted on the first end 16*a* and designed to contain the recirculation or movement means 10 inside the tubular element 16.

Clearly, also in this case, for supplying the recirculation or movement means 10, a cable 10*a* can be provided which is suitably guided within the tubular element 16 and from this out of the well zone WZ towards a junction box or a long cable. Of course, a power supply of the means of recirculation or movement by battery or solar energy can also be provided.

According to this variant, the filter 9 would preferably be mounted inside the supply duct 17.

In accordance 11 the present invention a process for adapting a traditional swimming pool, be it an infinity or skimmer swimming pool, providing it with the structure described above, is also provided.

Thus, for example, the edge zone 2 of this swimming pool should be suitably worked so as to create, along all or part of the perimeter of the edge zone 2, a first part 2*a* and a second part 2*b* on which a top wall 4 could be laid as indicated above.

If desired, at least one well zone WZ could also be created in which the components of the collection, filtering and recirculation circuit 5 are housed.

This would guarantee to convert a traditional swimming pool, with the defects of the same, to a swimming pool according to the present invention.

As it will be possible to ascertain, thanks to the present invention, when the recirculation or movement means 10 are activated or switched on, through the top wall 4, for example in each groove 6 enters a certain percentage of water sucked or deriving from the tank MB, which determines a difference in level between the first upper level HL1 of the water in the tank MB itself and the second upper level HL2 of the water in the recessed area RA causing a dragging of the water and therefore an acceleration of the flow of water through the top wall 4 or one or more segments of the same which causes a "recall" or suction of water and in particular also of dirt, from the tank MB. Owing to this, water is dragged from every point from the tank MB and from the edge zone 2, without the formation of water stagnation areas.

This would clearly not be obtained by placing a simple grid, whereby the top wall 4 or better the respective segments with the structure described above does not comprise a grid defining large openings, although in general a grid could also be provided along the edge zone 2.

Moreover, thanks to the inclination of the top wall 4 or the respective segments and the size of the same, it is possible to ensure a safe entry and exit of users in or from the tank MB and also an optimal operation of the hydraulic containment system of the pool.

In this regard, thanks to a solution according to the present invention it is possible, in fact, to increase the area of the swimming pool, since the latter actually extends with respect to that defined by the first surface 3 of an additional area between the first surface 3 and the end of the recessed area RA distal from the first surface 3.

With regard to this aspect, swimming pools must be equipped with compensation tanks, which are usually provided under the main tank of a swimming pool or in any case buried around the latter, to receive the water flowing out of the main pool as a result of the entry of a certain number of bathers, after which the water leaving the main tank is conveyed to the sewer.

The arrangement described above with reference to the top wall makes it possible to eliminate the need to provide compensation tanks, since the additional area between the first surface 3 and the end of the recessed area RA distal from the first surface 3 acts as a compensation tank.

In accordance with the present invention, a water collection channel outside the swimming pool is therefore not necessary according to the overflow principle, nor a compensation tank necessary in traditional systems, but barriers or walls are interposed between the main tank MB and the circuit 5, which communicates with the tank MB and is partially immersed, resulting in reduced water passages with respect to the flow rate of the means or pumps 10.

In a swimming pool structure according to the present invention, however, there is no direct suction into the tank, but only from underneath the top wall 4 or the segments thereof and if the water outlet into the tank is plugged, the pump or the means 10 stop and resume their operation after a certain period. This can be achieved according to the type of pump or means 10 or to any electronic or mechanical sensor means.

Therefore, a swimming pool structure according to the present invention complies with the regulations of the reference sector.

Furthermore, if a collection, filtering and recirculation circuit 5 is provided as indicated above, it is possible to completely disassemble the filter 9 and the recirculation or movement means, such as a pump or fan or propeller 10, even without lowering the water in the pool. In order to do this, it would be sufficient to lift or move, manually or by means of a suitable tool, one or more tiles 7 of the top wall 4 and then extract the respective the filter 9 and, if necessary, the pump or the recirculation or movement means 10, for example by disengaging the quick fitting or coupling means.

It is also possible to notice how all the components of the system which can undergo wear are in an easily accessible area and can be changed without any problems.

In the solutions proposed so far, instead should maintenance be made, it is necessary to access technical rooms where there is water, humidity and high voltage, as well as often dirt, a condition that obviously does not occur in accordance with the advantageous variant described above of the present invention.

There is also no need for underground pipes, which, like the technical rooms, are difficult to maintain.

Moreover, the arrangement of the recirculation or means 10 downstream of the filter 9 ensures that the recirculation or movement means 10 are crossed by water already filtered by the filter 9 unlike traditional systems in which the pump moves water before the filter.

In view of this, according to the preferred variant described, the pump does not need maintenance or in any case need of maintenance less than the systems proposed up to now. With regard to this aspect, usually the management of traditional swimming pools is carried out automatically, but this does not apply to the cleaning of the pump, which, being usually upstream of the filter, is crossed by water to be filtered and must be cleaned thoroughly manually.

Moreover, again in accordance with the advantageous embodiment described, the pump or the means 10 must not push water through a filter, so that the pump, which runs almost free, works at maximum efficiency and can also be at low power.

The position of the recirculation or movement means 10 according to the preferred embodiment illustrated in the figures, also guarantees the silence of the system, because the means 10 are at the bottom of the well zone WZ, considering what is indicated above in relation to the power of the means 10 or usable pumps.

Changes and variants of the invention are possible within the scope defined by the claims.

The invention claimed is:

1. A swimming pool structure having:

at least one edge zone comprising a first surface which delimits and surrounds a main tank (MB) for water containment and a plurality of tiles placed side by side and comprising a top wall of said at least one edge zone, wherein each tile has a front edge, a rear edge and two side edges, wherein each tile is inclined with respect to the horizontal and placed adjacent to each other, wherein the main tank (MB) comprises a water collection, filtering and recirculating circuit having at least one well zone under the top wall;

wherein at least one through groove is formed between each of said plurality of tiles, wherein each through groove extends from at least the front edge to the rear edge of each tile and from the top wall down to the at least one well zone, wherein said at least one through groove has a position inclined with respect to the horizontal, so as to have two terminal ends at different levels, comprised of a first terminal end that is lower than a second terminal end.

2. The swimming pool structure according to claim 1, wherein said front edge is in contact with or resting on a first part of the edge zone proximal to the first surface and the rear edge is in contact with or resting on a second part of the edge zone distal from the tank (MB) with respect to the first surface, wherein the front edge is at a level that is lower than the rear edge.

3. The swimming pool structure according to claim 2, in which starting from the first surface away from the main tank (MB), the edge zone comprises a first section, which is curved, horizontal or inclined with respect to the horizontal, then a second section vertical or inclined with respect to the vertical so that the level or vertical position of the second section decreases moving away from the first section, said first section defining the distance between the top wall and said first surface, said first part being provided by the second section moving away from the main tank (MB), said first part being made up of a third section which is substantially flat and horizontal or inclined with respect to the horizontal, which is at a level or vertical position lower than the first section.

4. The swimming pool structure according to claim 3, comprising a retaining component fixed to the upper end or corner of the first surface, said retaining component being designed to provide an abutment or containment surface for the first front edge, said retaining component having a substantially vertical main portion from which a portion with horizontal main extension departs away from the main tank (MB), which rests on the first part or on the respective third section substantially flat and horizontal or inclined with respect to the horizontal, wherein the upper surface of the main portion constitutes said first section, and the upper surface of the horizontal main section constitutes said second section.

5. The swimming pool structure according to claim 1, wherein the angle (A) defined between the portion of a first plane (FP) connecting the first front edge and the rear edge and the portion of a second horizontal plane (SP) underlying such portion of the first plane (FP) is greater than 0°.

6. The swimming pool structure according to claim 5, wherein said angle (A) is comprised between 5° and 60°.

7. The swimming pool structure according to claim 1, wherein said at least one respective segment is made of a draining agglomerate with porosity between 10 and 500 m2 g-1.

8. The swimming pool structure according to claim 1, wherein each through groove has a width between 5 mm and 25 mm.

9. The swimming pool structure according to claim 1, wherein the plurality of through grooves are spaced apart one from the other.

10. The swimming pool structure according to claim 1, wherein each of said plurality of tiles of the top wall comprises an intermediate portion extending between first front edge and the rear edge, wherein said intermediate portion is not supported from below from a main block of the edge zone, wherein the edge zone has a recessed area (RA) which subtends the intermediate portion of the aforementioned segment of the top wall.

11. The swimming pool structure according to claim 1, wherein said collection, filtering and recirculation circuit extends starting from an area below the top wall and is in fluid communication with the at least one through groove formed therein to receive water that passes therethrough, said circuit having an inlet mouth opening below the top wall.

12. The swimming pool structure according to claim 1, wherein said water collection, filtering and recirculating circuit in the main tank (MB) comprises at least one filter, mounted in the at least one well zone (WZ) and designed to intercept the water falling into it starting from the top wall, said circuit further comprising recirculation or movement means placed in a portion (WZ1) of the at least one well zone (WZ) downstream of the filter or in any case on the bottom of the at least one well zone (WZ) or in a position lower with respect to the at least one filter.

13. The swimming pool structure according to claim 12, wherein said at least one filter is a bag filter.

14. The swimming pool structure according to claim 13, wherein said recirculation or movement means comprise a pump.

* * * * *